US007379682B2

(12) United States Patent
Campbell et al.

(10) Patent No.: US 7,379,682 B2
(45) Date of Patent: May 27, 2008

(54) OPTIMIZATION OF OPERATING PARAMETERS, INCLUDING IMAGING POWER, IN AN ELECTROPHOTOGRAPHIC DEVICE

(75) Inventors: Alan Stirling Campbell, Lexington, KY (US); Cary Patterson Ravitz, Lexington, KY (US); Albert Munn Carter, Jr., Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 298 days.

(21) Appl. No.: 11/240,217

(22) Filed: Sep. 30, 2005

(65) Prior Publication Data

US 2007/0077081 A1 Apr. 5, 2007

(51) Int. Cl.
*G03G 15/00* (2006.01)

(52) U.S. Cl. ..... 399/49; 399/51

(58) Field of Classification Search ..... 399/49, 399/51; 347/253, 133, 236, 246
See application file for complete search history.

(56) References Cited

U.S. PATENT DOCUMENTS 5,049,939 A * 9/1991 Koichi ..... 399/48
5,404,203 A * 4/1995 Kinoshita et al. ..... 399/46
5,436,705 A * 7/1995 Raj ..... 399/59
5,453,773 A * 9/1995 Hattori et al. ..... 347/129
5,734,407 A * 3/1998 Yamada et al. ..... 347/133
5,797,064 A * 8/1998 Raj et al. ..... 399/46
6,133,934 A * 10/2000 Nakano ..... 347/246
6,483,996 B2 * 11/2002 Phillips ..... 399/38
6,501,917 B1 * 12/2002 Karasawa ..... 399/46
6,560,418 B2 * 5/2003 Campbell et al. ..... 399/49
6,650,849 B2 * 11/2003 Shimura ..... 399/49
6,700,595 B2 * 3/2004 Sugiyama et al. ..... 347/133
7,006,250 B2 * 2/2006 Denton et al. ..... 358/1.9

FOREIGN PATENT DOCUMENTS

JP 59133564 A * 7/1984
JP 2004306590 A * 11/2004

* cited by examiner

*Primary Examiner*—Robert Beatty
(74) *Attorney, Agent, or Firm*—Coats & Bennett, PLLC

(57) ABSTRACT

Control circuitry associated with an electrophotographic imaging device is adapted to operate in conjunction with a sensor to adjust operating parameters, including an imaging power. The sensor detects a reflectivity of a developed image and the control circuitry uses this detected information and information related to reflectivity of the underlying surface and the developing toner to determine whether the developed image is produced as desired. The control circuitry adjusts imaging power in response to a comparison between the detected reflectivity and a target reflectivity. In one embodiment, a predetermined halftone pattern is developed over a range of imaging powers and an optimum operating point is determined from the iterations. A predictive model may be generated based on many data points to select imaging power based on optimized surface potentials.

23 Claims, 11 Drawing Sheets

OPTIMIZATION OF OPERATING PARAMETERS, INCLUDING IMAGING POWER, IN AN ELECTROPHOTOGRAPHIC DEVICE

BACKGROUND

The electrophotography process used in some imaging devices, such as laser printers and copiers, utilizes electrical potentials between components to control the transfer and placement of toner. These electrical potentials create attractive and repulsive forces that tend to promote the transfer of charged toner to desired areas while ideally preventing transfer of the toner to unwanted areas. For instance, during the process of developing a latent image on a photoconductive surface, charged toner particles may be deposited from a biased developer roller onto latent image features (e.g., corresponding to text or graphics) on the photoconductive surface having a surface potential that is lower in magnitude than the developer roller. At the same time, the charged toner particles may be prevented from transferring or migrating to more highly charged areas (e.g., corresponding to the document background) of the same photoconductive surface. In this manner, imaging devices implementing this process may simultaneously generate images with fine detail while maintaining clean backgrounds.

The precise magnitudes of these electrical potentials vary among devices and manufacturers. In general, however, a laser or imaging source is used to illuminate and selectively discharge portions of a photoconductive surface to create a latent image having a lower surface potential than the remaining, undischarged areas of the photoconductive surface. The developer roller is biased to some intermediate level between the discharge potential of the latent image and the surface potential of the undischarged photoconductive surface. The toner may be charged triboelectrically and/or via biased toner delivery control components, such as a toner adder roll, a doctor blade, and a developer roller. The developer roller supplies toner to develop the latent images on the photoconductive surface. The developed image is ultimately transferred onto a media sheet, typically by employing yet another surface potential that attracts the toner off of the photoconductive surface (or an intermediate transfer surface) and onto the media sheet where it is ultimately fused.

The various surface potentials may be optimized to strike a balance between maintaining clear backgrounds while producing quality images with fine detail. For example, the surface potential of a developer roller may be optimized to develop images with a desired toner density. Another variable termed a "white vector" may be optimized as well. White vector refers to the difference between the surface potential of the developer roller and the surface potential of undischarged portions of a photoconductive surface. An optimal white vector achieves certain desirable characteristics, one of which is to provide a clean media sheet with little or no appreciable background toner in areas other than where printing is desired. Very large white vector values may adversely affect the density of deposited toner and detail of a resulting image. Conversely, as white vector values fall, unwanted background may begin to appear.

Even when these various surface potentials are optimized, image quality may be improved by further optimization of imaging power. Imaging power affects the formation of the latent image on a photoconductive surface. Consequently, incorrect imaging power settings may adversely affect image quality and halftone linearity. In some cases, the discharged latent image may not attract enough toner while in other cases, too much toner is attracted. The effects that are produced by changes in imaging power may vary depending on the surface potentials used in the image formation process. Thus, the imaging power may need to be optimized while taking into consideration the optimization of the various surface potentials. By the same token, optimization of the imaging power may affect the optimization of the various surface potentials. As a result, improved image production may dictate that these various operating points be optimized in consideration of one another.

SUMMARY

Embodiments of the present invention are directed to devices and methods for setting optimum operating points in an electrophotographic image forming device. An exemplary image forming device includes a developer, a photoconductive unit, and a charge member for adjustably charging the photoconductive surface. The image forming device also includes an imaging unit forming a latent image on the surface of the photoconductive unit by selectively exposing the charged photoconductive surface by illumination thereof. The imaging unit may have an adjustable imaging power. A sensing unit may detect a reflectivity of solid toner patches, of a toner carrying surface on which the toner is deposited, and of predetermined toner patterns. A controller may selectively adjust the imaging power in response to reflectivity values detected by the sensing unit.

In one embodiment, the controller may manage the creation of a plurality of predetermined latent images on the photoconductive surface where each of the predetermined latent images has a target halftone percentage. Further, each of the predetermined latent images may be generated with a different imaging power. Then, based on the reflectivity of the developed images, the controller may set the imaging power at an imaging power that produces a target reflectivity at the target halftone percentage.

In another embodiment, the controller may manage the creation of multiple sets of predetermined latent images. Each of the predetermined latent images may have a target halftone percentage. Each of the predetermined latent images within a set may be generated with a different imaging power. Further, each set may be generated with a different white vector. Based on the reflectivity of the developed images, the controller may generate a predictive model for setting the imaging power based at least partly on an imaging power that produces a target reflectivity for each set of predetermined latent images. The predictive model may then be used to set an imaging power based on optimization of the electrical potentials applied to the developer member and the photoconductive surface. Various additional embodiments are provided showing techniques for optimizing operating points based on system architecture.

DETAILED DESCRIPTION

Figure 1:
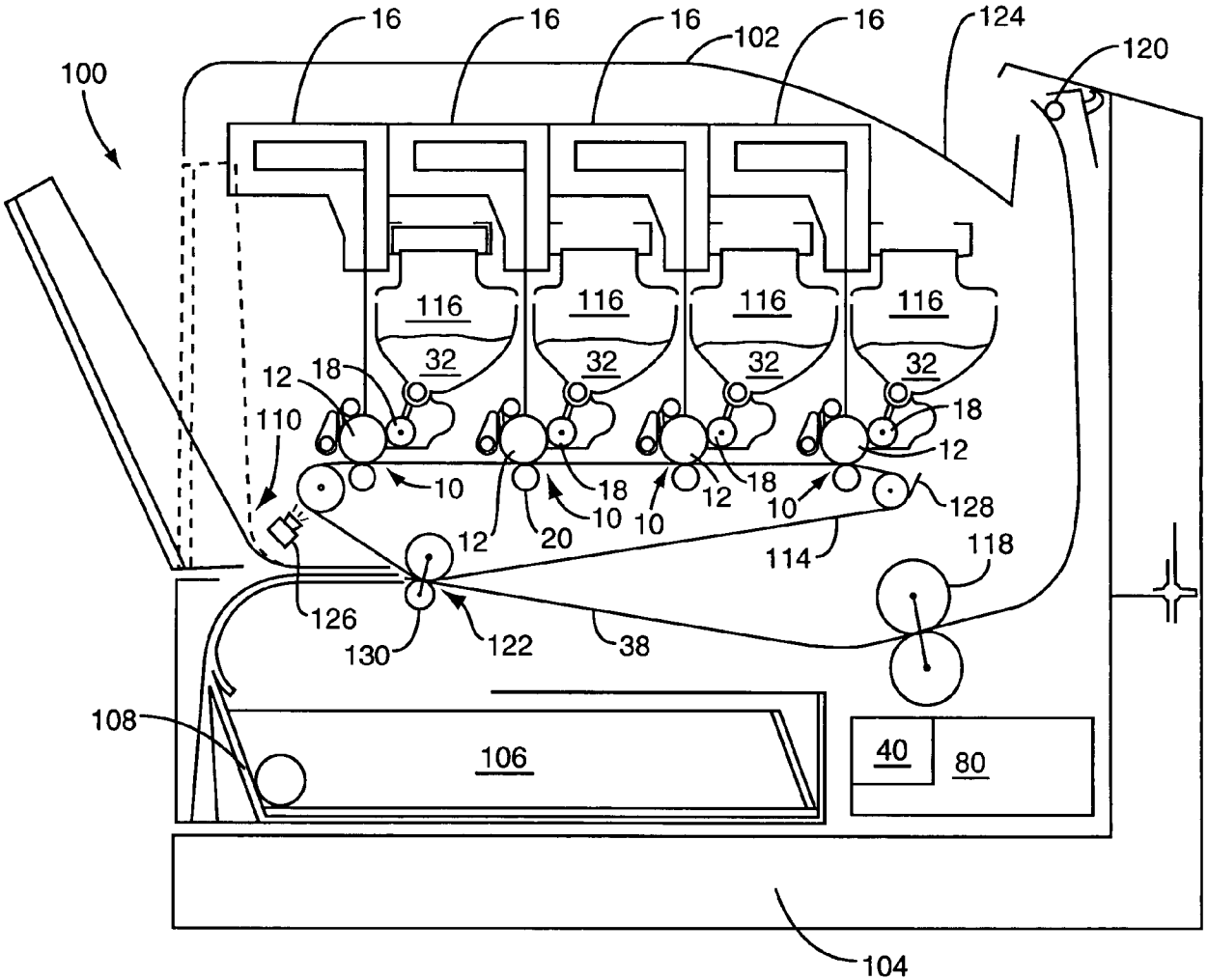
FIG. 1 is a functional block diagram of an image forming apparatus according to one embodiment of the present invention.

In electrophotographic image development, certain operating points may be varied and optimized to produce high quality images with little or no background noise (i.e., toner particles not intended to be transferred to the media sheet). Optimization of these operating points in a device such as the image forming apparatus 100 generally illustrated in FIG. 1 may be achieved with various embodiments disclosed herein. The image forming device 100 comprises a housing 102 and a media tray 104. The media tray 104 includes a main stack of media sheets 106 and a sheet pick mechanism 108. The image forming device 100 also includes a multipurpose tray 110 for feeding envelopes, transparencies and the like. The media tray 104 may be removable for refilling, and located in a lower section of the device 100.

Within the image forming device housing 102, the image forming device 100 includes one or more removable developer cartridges 116, photoconductive units 12, developer rollers 18 and corresponding transfer rollers 20. The image forming device 100 also includes an intermediate transfer mechanism (ITM) belt 114, a fuser 118, and exit rollers 120, as well as various additional rollers, actuators, sensors, optics, and electronics (not shown) as are conventionally known in the image forming device arts, and which are not further explicated herein. Additionally, the image forming device 100 includes one or more system boards 80 comprising controllers (including controller 40 described below), microprocessors, DSPs, or other stored-program processors (not specifically shown in FIG. 1) and associated computer memory, data transfer circuits, and/or other peripherals (not shown) that provide overall control of the image formation process.

Each developer cartridge 116 may include a reservoir containing toner 32 and a developer roller 18, in addition to various rollers, paddles and other elements (not shown). Each developer roller 18 is adjacent to a corresponding photoconductive unit 12, with the developer roller 18 developing a latent image on the surface of the photoconductive unit 12 by supplying toner 32. In various alternative embodiments, the photoconductive unit 12 may be integrated into the developer cartridge 116, may be fixed in the image forming device housing 102, or may be disposed in a removable photoconductor cartridge (not shown). In a typical color image forming device, three or four colors of toner—cyan, yellow, magenta, and optionally black—are applied successively (and not necessarily in that order) to an ITM belt 114 or to a print media sheet 106 to create a color image. Correspondingly, FIG. 1 depicts four image forming units 10. In a monochrome printer, only one forming unit 10 may be present.

The operation of the image forming device 100 is conventionally known. Upon command from control electronics, a single media sheet 106 is "picked," or selected, from either the primary media tray 104 or the multipurpose tray 110 while the ITM belt 114 moves successively past the image forming units 10. The surface of the photoconductive unit 12 is charged to a uniform potential. As described above, at each photoconductive unit 12, a latent image is formed thereon by optical projection from the imaging device 16. The latent image is developed by applying toner to the photoconductive unit 12 from the corresponding developer roller 18. The toner is subsequently deposited on the ITM belt 114 as it is conveyed past the photoconductive unit 12 by operation of a transfer voltage applied by the transfer roller 20. Each color is layered onto the ITM belt 114 to form a composite image, as the ITM belt 114 passes by each successive image forming unit 10. The media sheet 106 is fed to a secondary transfer nip 122 where the image is transferred from the ITM belt 114 to the media sheet 106 with the aid of transfer roller 130. The media sheet proceeds from the secondary transfer nip 122 along media path 38. The toner is thermally fused to the media sheet 106 by the fuser 118, and the sheet 106 then passes through exit rollers 120, to land facedown in the output stack 124 formed on the exterior of the image forming device housing 102. A cleaner unit 128 cleans residual toner from the surface of the ITM belt 114 prior to the next application of a toner image.

The representative image forming device 100 shown in FIG. 1 is referred to as a dual-transfer device because the developed images are transferred twice: first to the ITM belt 114 at the image forming units 10 and second to a media sheet 106 at the transfer nip 122. Other image forming devices implement a single-transfer mechanism where a media sheet 106 is transported by a transport belt (not shown) past each image forming unit 10 for direct transfer of toner images onto the media sheet 106. For either type of image forming device, there may be one or more toner patch sensors 126, to monitor a media sheet 106, an ITM belt 114, a photoconductive unit 12, or a transport belt (not shown), as appropriate, to sense various test patterns printed by the various image forming units 10 in an image forming device 100. The toner patch sensors 126 may be used for, among other purposes, registering the various color planes printed by the image forming units 10. In one embodiment, two toner patch sensors 126 may be used, with one at opposite sides of the scan direction (i.e., transverse to the direction of substrate travel).

Figure 2:
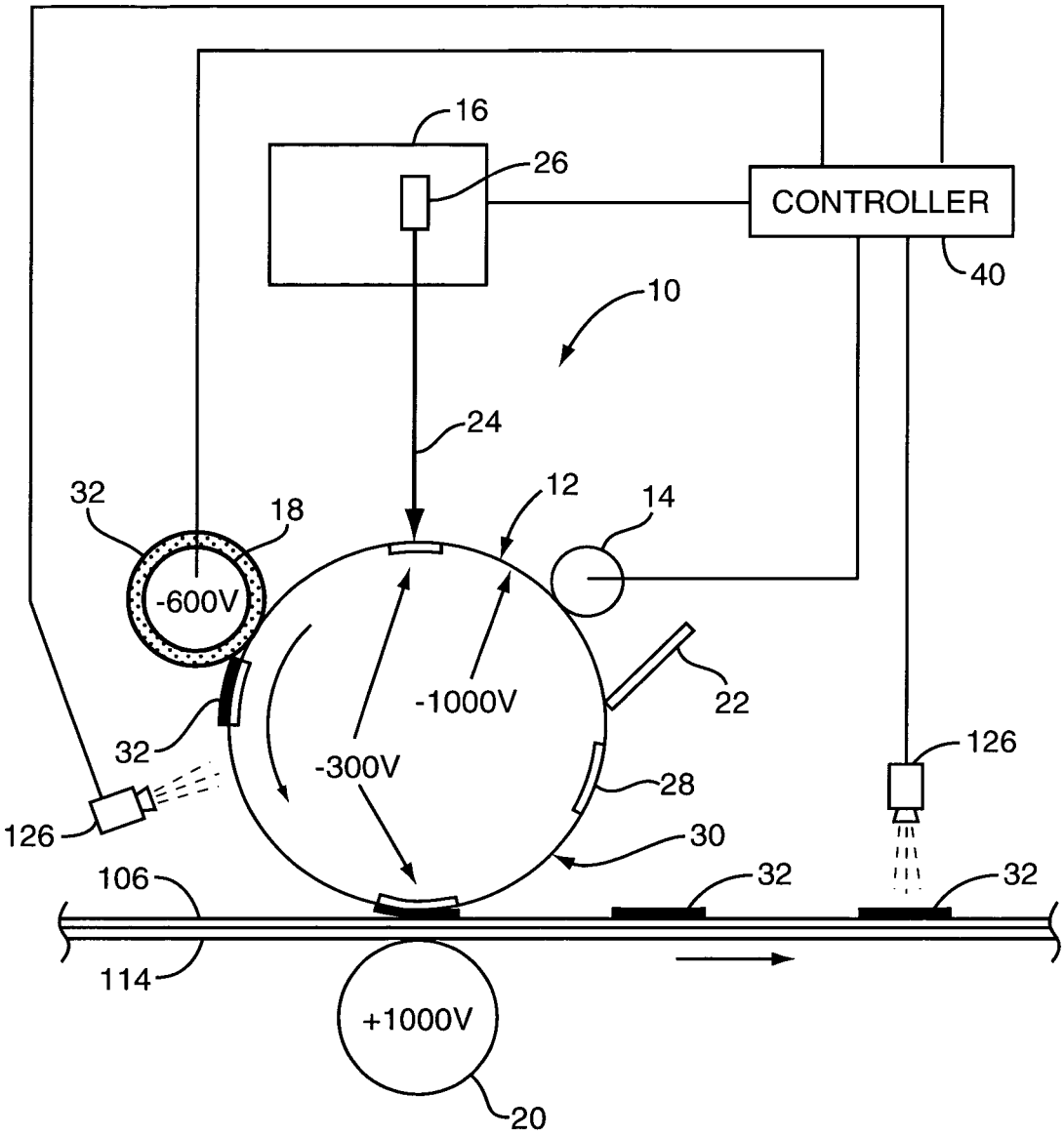
FIG. 2 is a schematic diagram of an image forming unit and an operating parameter controller according to one embodiment of the present invention.

FIG. 2 is a schematic diagram illustrating an exemplary image forming unit 10. Each image forming unit 10 includes a photoconductive unit 12, a charging unit 14, an imaging device 16, a developer roller 18, a transfer device 20, and a cleaning blade 22. In the embodiment depicted, the photoconductive unit 12 is cylindrically shaped and illustrated in cross section. However, it will be apparent to those skilled in the art that the photoconductive unit 12 may comprise any appropriate shape or structure, including but not limited to belts or plates. The charging unit 14 charges the surface of the photoconductive unit 12 to a uniform potential, approximately −1000 volts in the embodiment depicted. A laser beam 24 from a laser source 26, such as a laser diode, in the imaging device 16 selectively discharges discrete areas 28 on the photoconductive unit 12 that are developed by toner to form a latent image on the surface of the photoconductive unit 12. The energy of the laser beam 24 selectively discharges these discrete areas 28 of the surface of the photoconductive unit 12 to a potential of approximately −300 volts in the embodiment depicted (approximately −100 volts over a photoconductive unit 12 core voltage of −200 volts in this particular embodiment). Areas of the latent image not to be developed by toner (also referred to herein as "white" or "background" image areas) are indicated generally by the numeral 30 and retain the potential induced by the charging unit 14, e.g., approximately −1000 volts in the embodiment depicted.

The latent image thus formed on the photoconductive unit 12 is then developed with toner from the developer roller 18, on which is adhered a thin layer of toner 32. The developer roller 18 is biased to a potential that is intermediate to the surface potential of the discharged latent image areas 28 and the undischarged areas not to be developed 30. In the embodiment depicted, the developer roller 18 is biased to a potential of approximately −600 volts. Negatively charged toner 32 is attracted to the more positive discharged areas 28 on the surface of the photoconductive unit 12 (i.e., −300V vs. −600V). The toner 32 is repelled from the less-positive, non-discharged areas 30, or white image areas, on the surface of the photoconductive unit 12 (i.e., −1000V vs. −600V), and consequently, the toner 32 does not adhere to these areas. As is well known in the art, the photoconductive unit 12, developer roller 18 and toner 32 may be charged alternatively to positive voltages.

In this manner, the latent image on the photoconductive unit 12 is developed by toner 32, which is subsequently transferred to a media sheet 106 by the positive voltage of the transfer device 20, approximately +1000V in the embodiment depicted. Alternatively, the toner 32 developing an image on the photoconductive unit 12 may be transferred to an ITM belt 114 and subsequently transferred to a media sheet 106 at a second transfer location (not shown in FIG. 2, but see location 122 in FIG. 1). In certain instances, such as during inter-page system adjustment procedures, the toner 32 of the developed image may be transferred to the ITM belt 114 or, in the case of a single-transfer device, a transport belt (not shown). After the developed image is transferred off the photoconductive unit 12, the cleaning blade 22 removes any remaining toner from the photoconductive unit 12, and the photoconductive unit 12 is again charged to a uniform level by the charging device 14.

The above description relates to an exemplary image forming unit 10. In any given application, the precise arrangement of components, voltages, power levels and the like may vary as desired or required. As is known in the art, an electrophotographic image forming device may include a single image forming unit 10 (generally developing images with black toner), or may include a plurality of image forming units 10, each developing halftone images on a different color plane with a different color of toner (generally yellow, cyan and magenta, and optionally also black).

The difference in potential between non-discharged areas 30 on the surface of the photoconductive unit 12—that is, white image areas or areas not to be developed by toner—and the surface potential of the developer roller 18 is known as the "white vector." This potential difference (with the white image areas 30 on the surface of the photoconductive unit 12 being less positive than the surface of the developer roller 18 in the embodiment depicted) provides an electrostatic barrier to the development of negatively charged toner 32 on the white image areas 30 of the latent image on the photoconductive unit 12. A sufficiently high white vector is necessary to prevent toner development in white image areas; however, an overly large white vector detrimentally affects the formation of fine image features, such as small dots and lines. In exemplary embodiments of image forming devices, a white vector as low as 200-250V may result in acceptable image quality while preventing toner development in white image areas. Unfortunately, the optimal white vector for each image forming unit 10 within an image forming device may be different, due to environmental conditions, differing toner formulations, component variation, difference in age or past usage levels of various components, and the like. Controller 40, via sensor 126, monitors toner 32 formation on media sheet 106 or belt 114 and adjusts the surface potential of the surface of photoconductive unit 12 (via charging device 14) and the surface potential of developer roller 18. Thus, while exemplary voltages establishing a white vector of 400V (i.e., |−1000V−−600V|) are explicitly shown in FIG. 2, actual operating voltages may be adjusted from these exemplary voltages by controller 40 implementing the teachings provided herein. Furthermore, the controller 40 may also control the amount of power used by the imaging device 16 to develop latent images on the surface of the photoconductive unit 12. Optimization of these operating points is described in greater detail below.

In an exemplary embodiment, controller 40 at least partially manages the formation of a predetermined pattern of toner 32 on a substrate, which may comprise a media sheet 106 or belt 114 (e.g., a transfer or ITM belt). A toner patch sensor 126 detects a reflectivity of the transferred pattern. Controller 40 adjusts the bias voltage of the charging device 14 and/or developer roller 18 and/or imaging power as needed to optimize image formation at least partly based on information provided by the toner patch sensor 126. The toner patch sensor 126 may be configured to sense the developed patterns 32 on a substrate 106, 114. Additionally, or alternatively, the toner patch sensor 126 may be configured to sense the developed patterns 32 on the surface of the photoconductive unit 12. Generally, the toner patch sensor 126 may be disposed adjacent any toner carrying surface to sense reflectivity of toner 32, the underlying toner carrying surface, or both. Further, the term reflectivity as used herein is intended to broadly encompass that measurable electromagnetic (optical or otherwise) energy or frequency sensed by the toner patch sensor 126 and may encompass such terms as luminosity, luminance, or reflectance. In certain instances, it may be desirable to print toner on toner images (e.g., black on yellow or other combinations) to achieve greater contrast between the developed image and the toner carrying surface. Thus, the toner carrying surface may comprise a solid toner patch of a different color disposed on the substrate 106, 114 or the photoconductive unit 12. Controller 40 establishes an operating point that will prevent background noise while creating a developed image with fine detail that approaches a desired standard.

Initially, one or more solid toner patches are developed and transferred to the substrate 106, 114 to determine an appropriate bias level for developer roll 18. The solid toner patches 32 are transported towards toner patch sensor 126, which measures a reflectivity of the solid toner patch. Various quantities may be sensed by the toner patch sensor 126 depending on the choice of color model. In one embodiment where an L-A-B color model is used, the L component (luminance or lightness) may be measured for black, cyan, and magenta toner patches while the B chromatic component may be measured for yellow toner patches. In either case, the detected value provides a measure of the density of the developed toner patch. The process may be repeated over a range of developer bias values with toner patch sensor 126 measurements taken at each value. The controller 40 may then adjust the developer bias accordingly to achieve a target solid color. During this process, the toner patch sensor 126 also determines the reflectivity of the background. In the absence of unwanted toner, the detected value is simply the reflectivity of the toner carrying surface, which may be the underlying substrate 106, 114, or the surface of the photoconductive unit 12.

Figure 3:
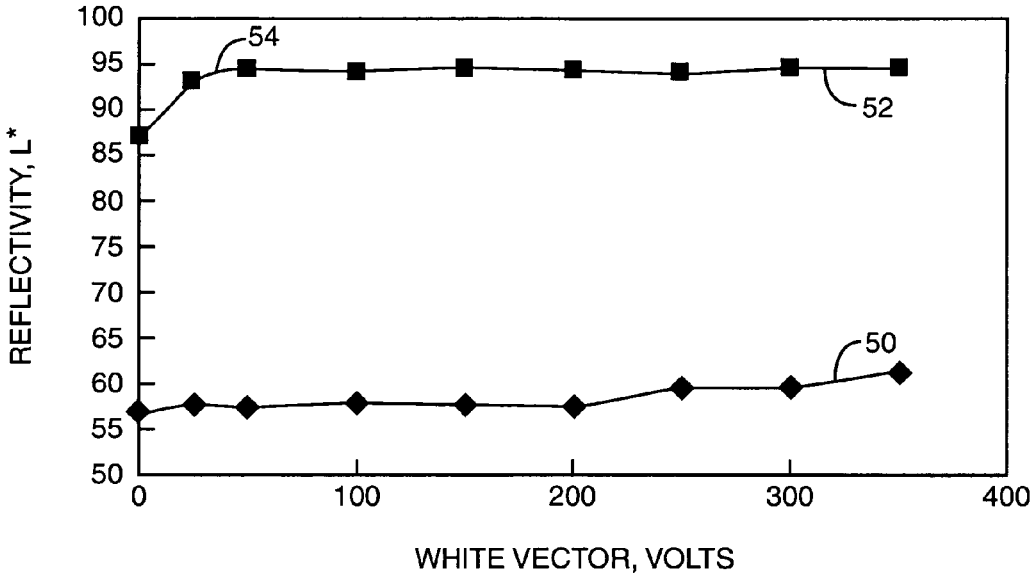
FIG. 3 is a graphical representation of the relationship between reflectivity and white vector according to one embodiment of the present invention.

With the developer roller 18 bias established relative to the discharge bias of latent images 28 on the surface of the photoconductive unit 12, the white vector may now be determined relative to the developer roller 18 bias. That is, in this exemplary embodiment, the white vector is established by adjusting the charging device 14 bias level while maintaining a fixed developer roller 18 bias. FIG. 3 graphically shows the effect of white vector on the reflectivity L* (and hence, density) of an exemplary solid patch, indicated by reference number 50. FIG. 3 also shows a similar effect on an exemplary background area, indicated by reference number 52. In the example provided, the exemplary substrate is a media sheet 106 that has a higher reflectivity L* than the toner 32. Thus, in the example shown, there is generally an inverse relationship between reflectivity L* and toner density. In other words, an increase in the density of toner 32 is reflected by lower points on the vertical axis, while upper points on the vertical axis correspond to a lower density of toner 32. The background area represented by curve 52 in FIG. 3 is an area of a developed image that is intended to be free from toner. The reflectivity values L* may be detected using a toner patch sensor 126 as previously discussed and shown in FIGS. 1 and 2. The reflectivity values L* of the background area are detected for the substrate, which in the example shown in FIG. 3 comprises a media sheet 106. Those skilled in the art should comprehend that similar reflectivity L* curves may be generated for substrates embodied as an internal belt 114 (transfer or ITM), or a solid patch of a different color. For example, if the background substrate is a belt 114, the reflectivity L* of the belt may be lower than the reflectivity L* of a solid toner patch. It should also be noted that curves similar to those presented in FIG. 3 may be produced if other color vectors (e.g., B*) and other color models (e.g., RGB, HSB, etc . . . ) are used.

As FIG. 3 shows, the curve 50 representing reflectivity L* of the solid toner patch is generally flat for white vector values in the range of about 0-200 volts. As the white vector increases above this range, reflectivity L* begins to increase, indicating that the substrate 106 is beginning to appear in areas that are intended to be covered with toner 32. Since the exemplary media sheet 106 has a higher reflectivity L* than the toner 32, the net effect is that the reflectivity of the toner patch increases at large white vector values due to insufficient toner coverage.

FIG. 3 further shows that the upper curve 52 representing the reflectivity L* of the background area is generally flat except at low white vector values. For the exemplary curve 52 shown, at white vector values in the range below a critical point 54 of about 50 volts, toner noise begins to appear in the background area. Since the exemplary toner 32 has a lower reflectivity L* than the exemplary substrate 106, the net effect at low white vector values is that the reflectivity of the background decreases due to toner deposition in the background areas. Consequently, for the present example shown in FIG. 3, an optimal value for white vector appears to be within the range of about 50 volts to about 200 volts. In one embodiment, white vector may be established by adding some safety margin to the value at the critical point 54. For example, if the critical point 54 occurs at a white vector of about 50 volts, a safety margin of 50 to 100 volts may be added to establish a white vector of between 100 and 150 volts. An appropriate safety margin may be determined from a knowledge of system configurations, operating conditions, and life expectancy.

In the embodiment shown, the critical point 54 is somewhat easily detectable because of the relatively large difference in reflectivity L* between the media sheet 106 and toner 32. In other situations where the reflectivity L* between the toner 32 and the substrate (be it a media sheet 106 or a belt 114) are similar, it may be more difficult to identify the critical point 54. For example, it may be difficult to identify the critical point 54 where black toner patches are printed on a black ITM belt 114. Accordingly, it may be possible to estimate the critical point 54 for a given color based on critical points of another color. In one embodiment, the same white vector value may be used. In one embodiment, the same white vector value and the same safety margin may be used. Modifications to the white vector estimate and/or the safety margin may be based on perception thresholds, toner formulations, and empirical data.

While it may be possible to set a fixed white vector using these approaches, the exemplary curves 50, 52 change over time and the optimal white vector range may shift up or down depending on factors such as toner and substrate types, environment, imaging device components, and age. Thus, different approaches using toner patch sensing may be implemented to set the white vector operating point.

One method uses the concept of "bloom" to set the white vector. Bloom represents a description of the extent to which a printed detail is wider or narrower than was intended, which results in printed area coverages that are larger or smaller than intended. Bloom may be estimated by sensing reflectance values of fine toner patterns and comparing an expected reflectance to the actual reflectance. The toner patterns may comprise fine dot patterns or fine line patterns where toner features are spaced apart a known amount. For instance, in one embodiment, latent images of horizontal or vertical lines having a width of $1/600^{th}$ inch and spaced apart by $1/600^{th}$ inch may be analyzed. Alternatively, a dot pattern comprised of a series of $1/600^{th}$ inch dots spaced apart by $1/600^{th}$ inch may be analyzed. In lieu of measuring the width of the toner features in printed patterns, the previously mentioned toner patch sensor 126 may be used to measure the reflectivity of these developed patterns, as well as solid toner patterns, and the underlying surface. Given these reflectance values, bloom may be estimated by:

$$\text{Bloom} = \frac{L*\text{substrate} - L*\text{pattern}}{(L*\text{substrate} - L*\text{solid}) \times \%_\text{Ideal_Coverage}}$$

where L*substrate represents the reflectivity of the toner carrying surface, L*pattern represents a measured reflectivity of an area of the pattern, L*solid represents a reflectivity of a solid toner patch, and %_Ideal_Coverage represents a known percentage of the area that should be covered with toner. As indicated above, the toner carrying surface may be a substrate 106, 114, the photoconductor surface 12, or toner of a different color. Bloom may be calculated over a range of white vector values. Then the white vector operating point may be set at a value that produces a desired bloom. In one embodiment, a bloom of one is sought. A detailed description of this method and other various methods of optimizing white vector in an electrophotographic image forming device is provided in commonly assigned U.S. patent application Ser. No. 11/126,814 entitled "White Vector Feedback Adjustment" filed May 11, 2005, the relevant portions of which are incorporated herein by reference.

The preceding discussion has provided a description of exemplary methods used to adjust the surface potential of different components, including the developer roller 18 and the photoconductive unit 12. Additional improvements in print quality may be obtained through adjustment of imaging power that account for the aforementioned surface potential adjustments. Imaging power adjustments should also consider the effect on the full range of halftones reproduced by a given image forming unit 10.

Figure 4:
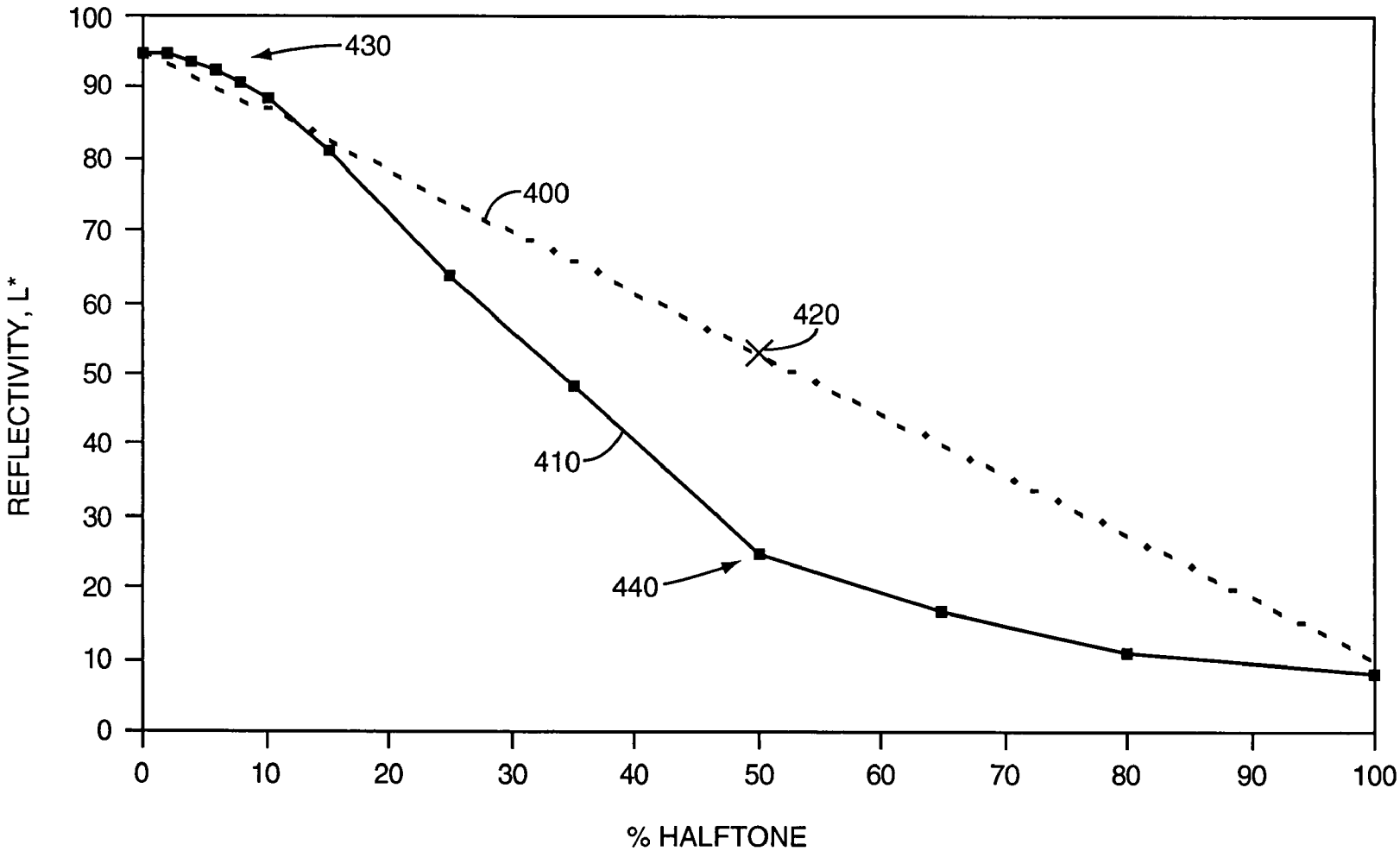
FIG. 4 is a graphical representation of the relationship between reflectivity and halftone percentage according to one embodiment of the present invention.

FIG. 4 is provided as a preliminary introduction to the problem of reproducing a continuous, linear range of halftones for a given color. The graph presented in FIG. 4 shows two halftone response curves. The dashed line represents an ideal, linear halftone response. For the example shown, the bare substrate 106, 114 has a reflectivity L* of 95 and a solid toner patch has a reflectivity L* of 10. All points in between these two extremes are produced using halftone patterns. Color imaging devices sometimes use halftone screens to combine a finite number of colors (usually four) and produce, what appears to the human eye, many shades of colors. In order to print different colors, they are separated into several monochrome layers for different colorants, each of which is then halftoned. The halftone process converts different tones of an image into spatial dot patterns that fill some percentage of a given screen. Smaller halftone percentages are produced by fewer dots in a halftone screen. Conversely, larger halftone percentages are produced by larger clusters of dots in a halftone screen. The halftone percentage is represented along the horizontal axis of FIG. 4.

The straight, dashed line 400 in FIG. 4 represents an ideal halftone response in that the percentage of halftone coverage produces a corresponding linear change in reflectivity L*. For example, data point 420 represents a 50% halftone screen that theoretically comprises about half toner 32 and half substrate 106, 114. The corresponding reflectivity L* should then be the average of the 95 and 10 extremes discussed above (i.e., L*≅52-53).

By comparison, the exemplary halftone response curve 410 shows typical reflectivity L* values produced by an image forming unit 10 for one set of images comprising a full range of halftone screen percentages. The image forming unit 10 that was used to generate the curve 410 was optimized to produce a white vector that was large enough to prevent background noise on unprinted areas. Further, the developer bias and imaging power were adjusted to provide the desired reflectivity value of 10 for a solid toner patch (100% halftone). In one embodiment, a developer roller 18 bias of about −600 volts and a white vector of about 200 volts may be used. In one embodiment, an imaging power of about 50% for an imaging device 16 capable of producing an exposure level of about 1.1 micro-Joules per square centimeter at 100% power may be used. These values are merely intended to be representative values used in producing the response curve 410 shown in FIG. 4. With these adjustments to the system operating points, FIG. 4 shows that the image forming unit 10 prints lighter than desired at small halftone percentages (indicated by the arrow labeled 430) and darker than desired at large halftone percentages (indicated by the arrow labeled 440). Stated another way, the system response curve 410 is above the ideal response curve 400 in the small halftone region 430 and below the ideal response curve 400 in the large halftone region 440. At a 50% halftone screen, the response curve 410 has a reflectivity L* value of about 24-25 compared to the reflectivity L* of about 52-53 reflected by data point 420 on the ideal response curve 400.

Figure 5:
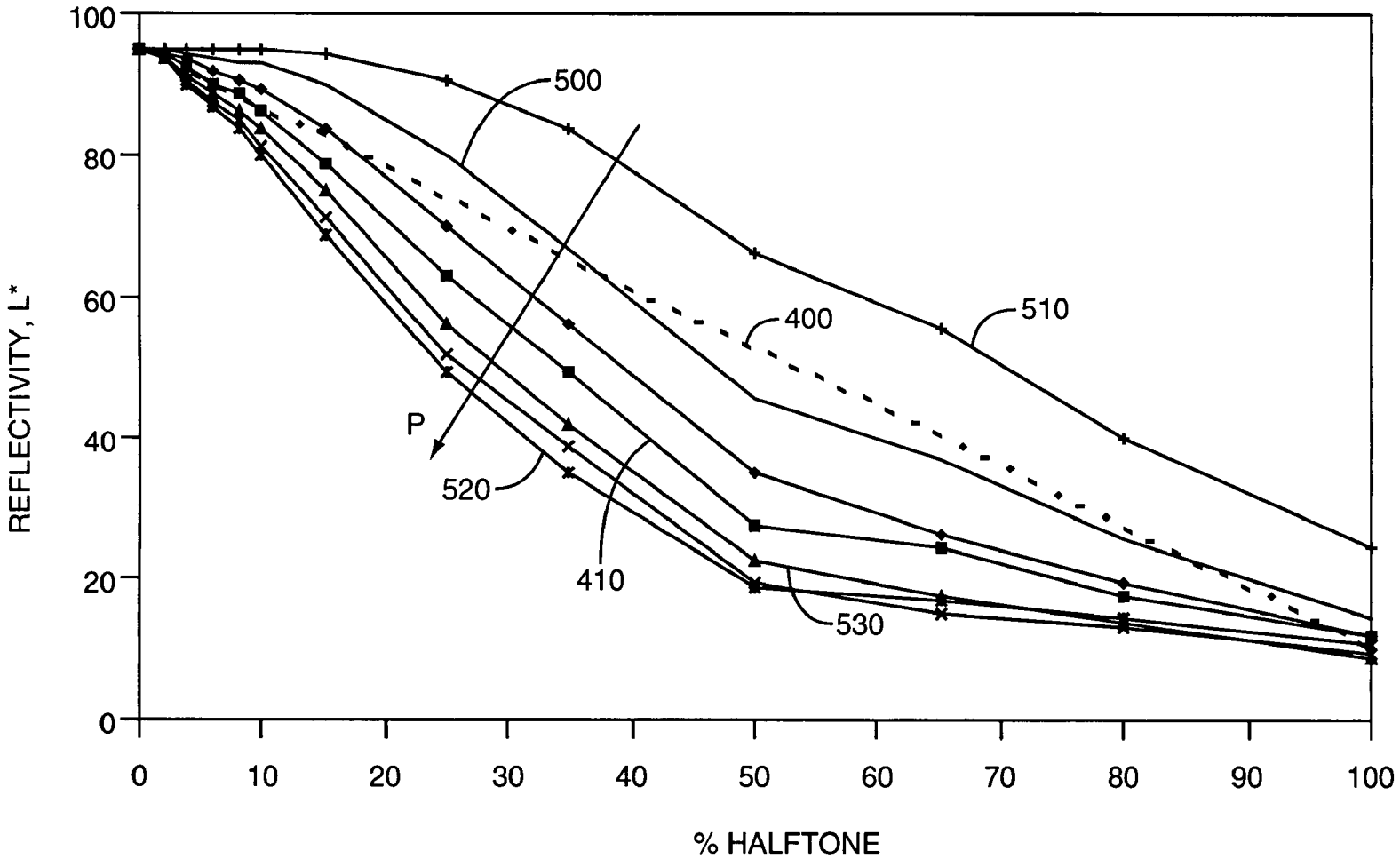
FIG. 5 is a graphical representation of the relationship between reflectivity and halftone percentage over a range of imaging powers according to one embodiment of the present invention.

The exemplary halftone response curve 410 is generated using one fixed imaging power. The graph presented in FIG. 5 shows a plurality of halftone response curves generated over a range of imaging powers. The response curves shown in FIG. 5 may be generated using the same operating points for developer roller 18 bias and white vector as that used in FIG. 4. Accordingly, FIG. 5 includes the two halftone response curves 400, 410 shown in FIG. 4. The arrow P illustrated in FIG. 5 represents increasing imaging power. For example, the uppermost curve 510 may indicate a 20% imaging power while the lowermost curve 520 may indicate an 80% imaging power with evenly spaced levels used therebetween. At low imaging power, the reflectivity L* is higher than ideal. Conversely, at high imaging power, the reflectivity L* is smaller than ideal.

Note also that the reflectivity L* of a solid toner patch (100% halftone) revealed by the end point of each curve also varies in response to imaging power. Thus, one simple optimization procedure is to select an imaging power that produces a target reflectivity L*. Another optimization is to select the smallest imaging power that produces a reflectivity L* that falls within a specified range of a target reflectivity L*. Unfortunately, these approaches may not necessarily take into consideration the halftone response at values less than 100%. Consequently, other optimization procedures that are based on the reflectivity L* of a solid toner patch may be used.

Another optimization seeks to match the ideal response 400. Referring to FIG. 5, the response curve 500 most closely matches the ideal curve 400 and provides the best linearity. Therefore, the imaging power that corresponds to this particular curve may be selected as an optimal operating point. One drawback to this approach that is suggested by this particular response curve 500 is that the reflectivity L* remains very near that of the substrate 106, 114 for low halftone percentages. In fact, the reflectivity L* does not appreciably vary from an L* value of 95 below the 10% halftone region. Furthermore, this response curve 500 remains higher than the ideal curve 400 until about the 40% halftone region. This characteristic may be interpreted to mean that at this particular imaging power, very fine details, including isolated dots and lines, are not accurately reproduced. This may occur because the imaging power is insufficient to discharge very small, isolated regions of a charged photoconductive layer. As a result, these small, isolated features are not adequately developed.

In light of these issues, an alternative solution may be to select an imaging power that provides better linearity at low halftone percentages. High imaging powers, such as that represented by curves 520 or 530, produce a response that deviates greatly from and is always below the ideal curve 400. Further, above the 50% halftone region, the halftone response is relatively flat. In other words, approximately half of the adjustability range is lost because changes in halftone percentage above about 50% produce negligible changes in reflectivity L*.

One possible compromise is to select an imaging power that produces a reflectivity that is near ideal at a target halftone percentage. For example, a target halftone percentage of between 5% and 40% may be selected. Inherent in this solution is a response curve that crosses the ideal curve 400 at some target halftone percentage. Below this target halftone percentage, the reflectivity L* is above (lighter than) the ideal curve 400. Above this target halftone percentage, the reflectivity L* is below (darker than) the ideal curve 400. Different values for the target halftone percentage may be used. On one hand, a lower target halftone percentage may result in better isolated detail at the expense poor linearity at high halftone percentages. On the other hand, a higher target halftone may result in better overall linearity at the expense of poor isolated detail at low halftone percentages. In one embodiment, a target halftone percentage of about 10% may be selected as a suitable compromise. FIGS. 4 and 5 reveal that the system response curve 410 most closely matches this target halftone percentage.

Figure 6:
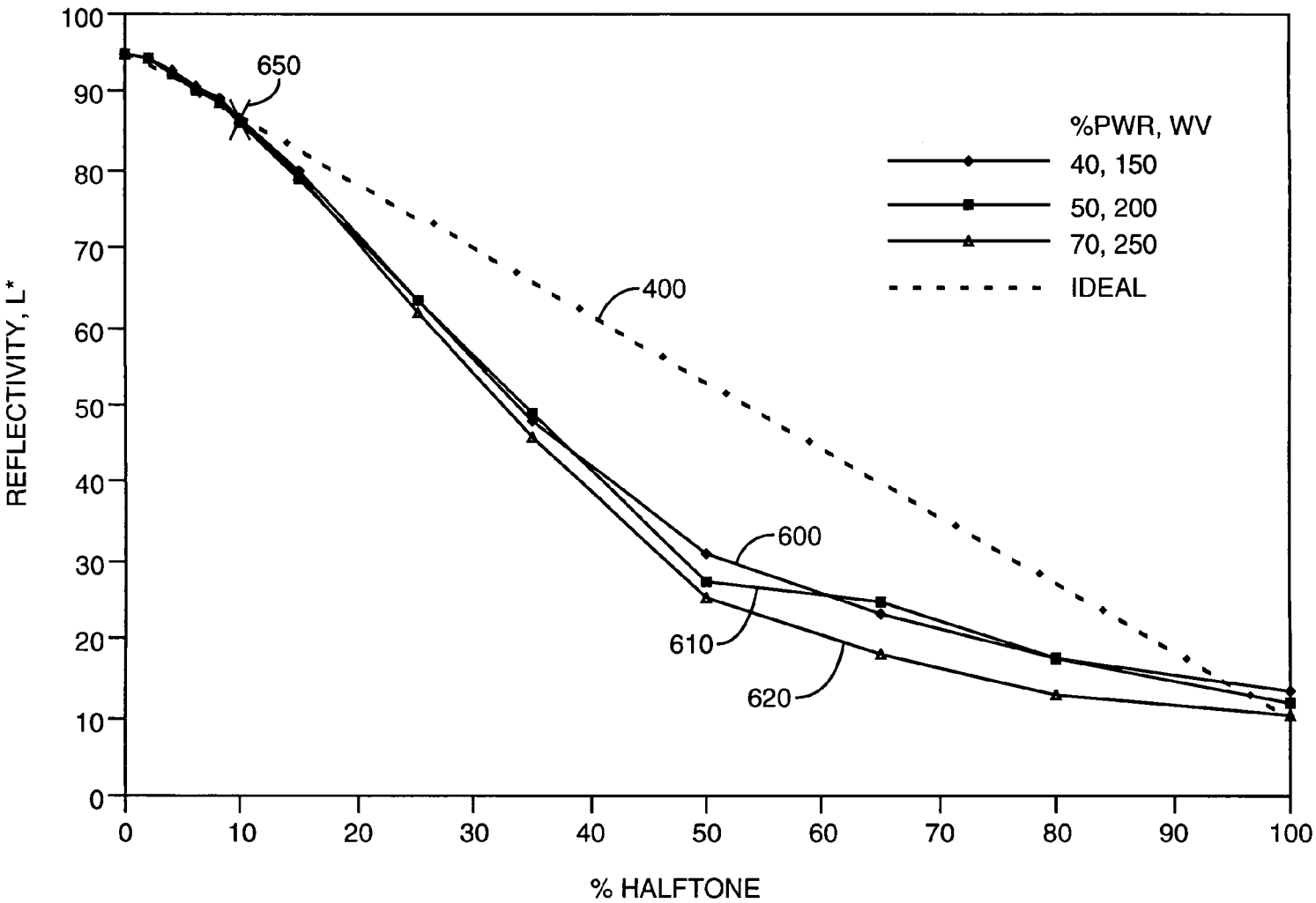
FIG. 6 is a graphical representation of the relationship between reflectivity and halftone percentage for different imaging power and white vector values according to one embodiment of the present invention.

An optimal value for the imaging power depends upon white vector. It has been determined that in order to produce a reflectivity L* that is near ideal at the target halftone percentage, the imaging power may need to be changed at different values of the white vector. The white vector used to produce each of the halftone response curves in FIGS. 4 and 5 was constant. Different sets of halftone response curves similar to that shown in FIG. 5 may be generated for different white vector values. Then, within each set of curves, the curve that has a reflectivity L* that is near ideal at the target halftone percentage may be selected. The imaging power corresponding to that curve may also be selected as an operating point. FIG. 6 shows three separate curves 600, 610, 620 generated with different white vector values and different imaging powers that closely match an ideal reflectivity L* at a target halftone percentage. In the exemplary embodiment shown, a target halftone percentage of about 10% is used. As discussed above, different values for the target halftone percentage may be used.

In FIG. 6, the ideal reflectivity L* at the target halftone percentage is represented by the point labeled 650. Each of the three halftone response curves 600, 610, 620 crosses the ideal curve 400 at or near this point 650. In the embodiment shown, imaging power is proportionally related to white vector. Thus, lower imaging powers may be used with lower white vector values. For example, a 40% imaging power corresponds to a white vector of 150 volts. A 50% imaging power corresponds to a white vector of 200 volts. Lastly, a 70% imaging power corresponds to a white vector of 250 volts.

Figure 7:
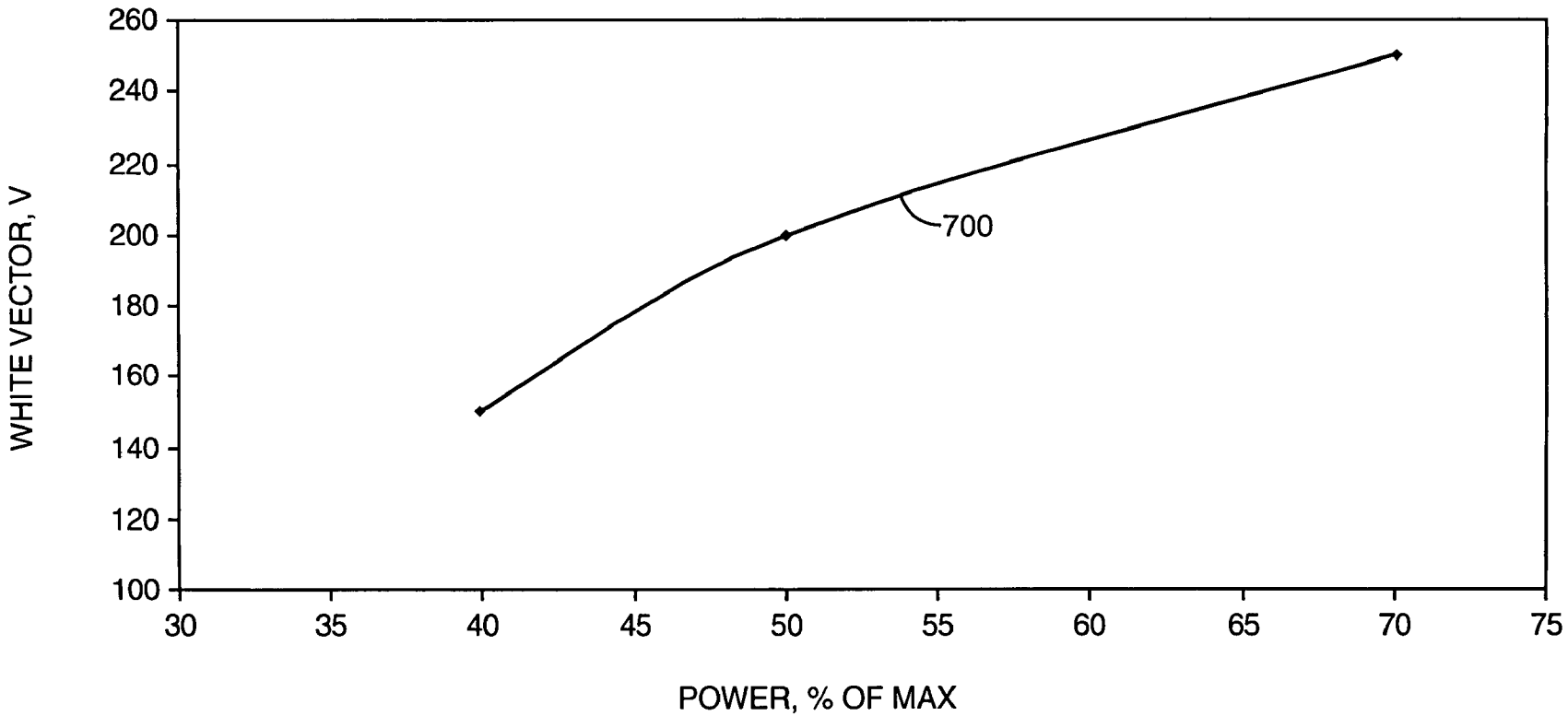
FIG. 7 is a graphical representation of a predictive model defining a relationship between white vector and imaging power according to one embodiment of the present invention.

These and additional operating points that correlate imaging power to white vector values may be used to construct an operating curve 700 such as the one shown in FIG. 7. For example, at various white vector values, sets of test patterns may be printed and analyzed over a range of imaging values to determine the imaging value in each set that generates an ideal reflectivity L*. Those values in each set may then be used to construct the operating curve 700, which reflects an example of one optimal relationship between white vector and imaging power. Once an operating curve 700 such as this is created, the data points represented by the operating curve 700 may be stored in system memory as a look up table accessible by controller 40 or as a best-fit equation executable by controller 40 to set the imaging power after white vector has been optimized. By the same token, white vector may also be set based on an optimized imaging power using this operating curve 700. In essence, operating along this operating curve may advantageously provide a combination of imaging power and white vector that produces consistent halftone reproduction and fine detail reproduction.

Figure 11:
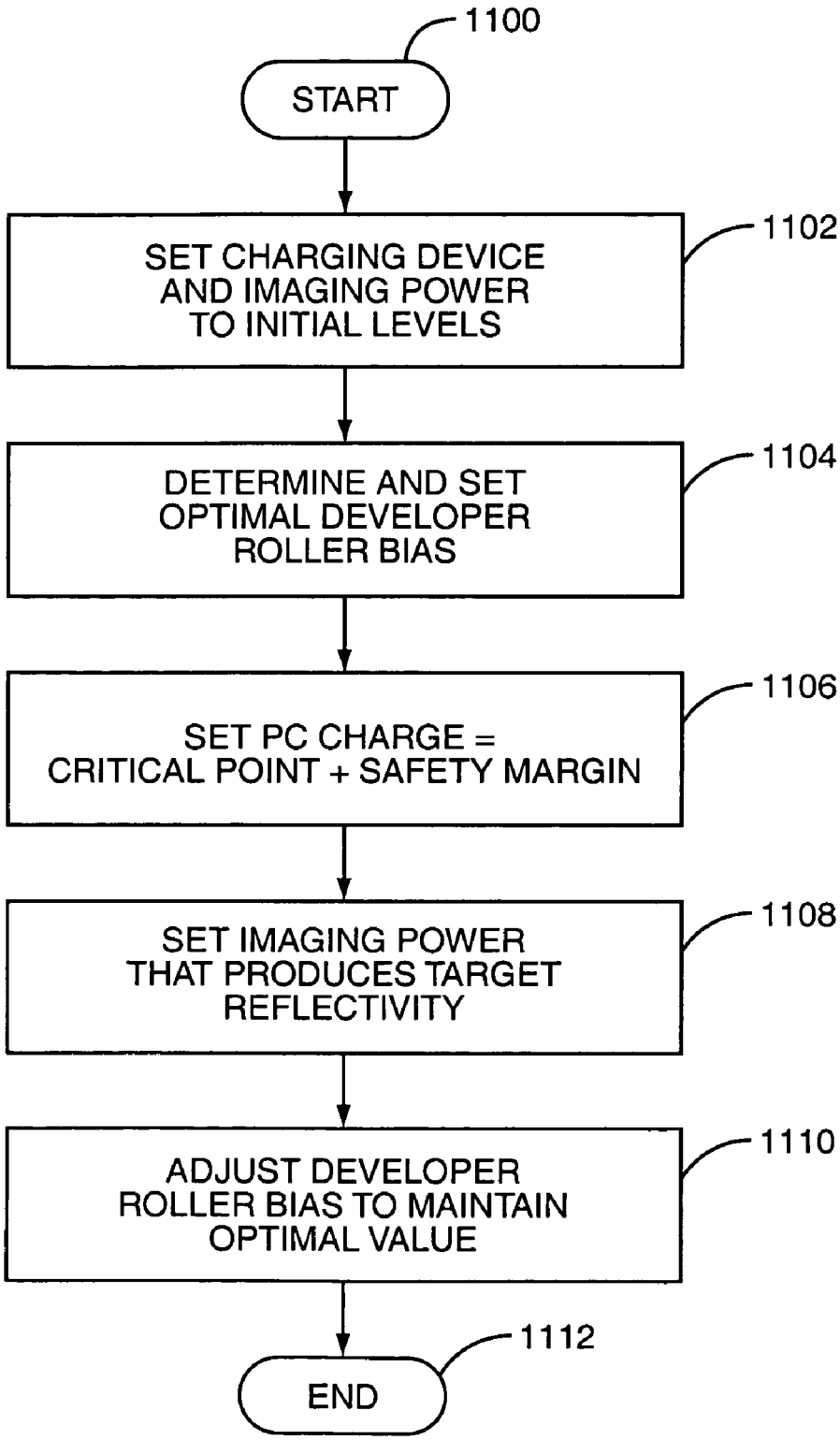
FIG. 11 is a flow diagram of one method of setting operating parameters according to the present invention.

The procedure outlined in FIG. 11 outlines one general method of optimizing the various operating points for an imaging forming unit 10 as illustrated in FIG. 2. The process starts at step 1100 and may be initiated at startup, between print jobs, or in conjunction with other inter-page adjustment procedures. Initially, the sequence shown in FIG. 11 attempts to optimize developer bias. To do this, the routine sets initial values for the photoconductive charging device 14 and the imaging power at step 1102. For example, the white vector may be set to an initial value that has been shown not to produce background noise in non-printed areas. Similarly, the imaging power may be set to an initial value that is some function of the process speed. Then, in step 1104, the controller 40 determines and sets an optimal developer roller 18 bias that produces a target reflectivity L* for a solid toner patch.

Next, iterative procedures may be implemented to determine optimum levels for the white vector and imaging power. The controller 40 may determine the critical point 54 by generating toner patterns over a range of photoconductor 12 bias levels. These patterns are analyzed by the controller 40 using the patch sensor 126 as shown in FIG. 2 and the critical point 54 is identified. Then, the photoconductor 12 charge level is set in step 1106 to this critical value 54 plus some safety margin. As suggested above, this guarantees that there will be no background noise produced by the image forming unit 10.

Next, in step 1108, imaging power may be optimized. The controller 40 sweeps through a series of imaging powers while printing toner patterns. Then, based on readings from toner patch sensor 126 and reflectivity values, the controller 40 sets the imaging power at a level that produces a target reflectivity. This target reflectivity may be an ideal reflectivity L* representative of an ideal halftone linearity as shown in FIGS. 4-6. In one embodiment, the controller may determine an imaging power that produces a reflectivity that is near ideal at a target halftone percentage. Similarly, the target reflectivity may be a value that produces an ideal bloom. Lastly, at step 1110, the developer roller 18 bias is adjusted in an effort to maintain an optimal reflectivity value L*, which may be adversely affected during the process of setting the photoconductor 12 charge level and setting a new imaging power. This adjustment may also be executed between steps 1106 and 1108 as needed. This developer bias adjustment may be minor and may be a predicted value or may be determined by sensing the reflectivity L* of a second series of solid toner patches. Once the process steps illustrated in FIG. 11 are complete, the routine ends (Step 1112) and the image forming device 100 may resume normal operations or enter into other configuration routines.

Having established several approaches to optimize imaging power in relation to white vector, the following description provides various approaches for implementing these optimization procedures. The embodiments discussed below may provide flexibility in applying the teachings provided herein to various system configurations. For example, certain image forming devices 100 may have shared power supplies and shared controllers 40 that limit whether individual operating points may be set at each image forming unit 10. Various configurations are discussed below.

Figure 8:
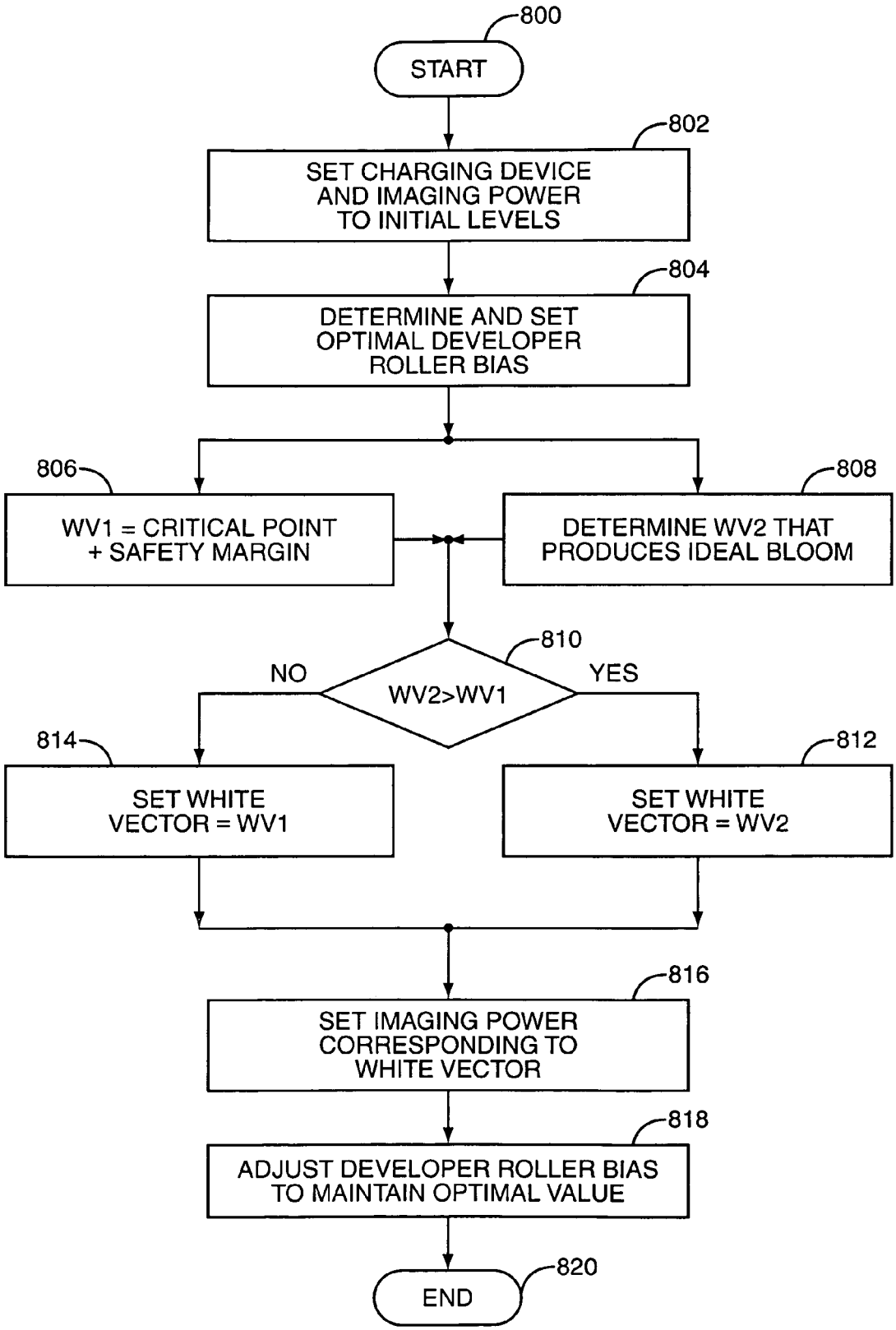
FIG. 8 is a flow diagram of one method of setting operating parameters according to the present invention.

One embodiment illustrated in FIG. 8 may be applicable to an image forming device 100 having independently adjustable (i.e., for each image forming unit 10) imaging powers, developer roller 18 bias levels, and white vector values. Thus, the procedure outlined in FIG. 8 may be performed for each image forming unit 10. The process starts at step 800 and may be initiated at startup, between print jobs, or in conjunction with other inter-page adjustment procedures. Initially, the sequence shown in FIG. 8 attempts to optimize developer bias. To do this, the routine sets initial values for the photoconductive charging device 14 and the imaging power at step 802. For example, the white vector may be set to an initial value that has been shown not to produce background noise in non-printed areas. Similarly, the imaging power may be set to an initial value that is some function of the process speed. Then, in step 804, the controller 40 determines and sets an optimal developer roller 18 bias that produces a target reflectivity L* for a solid toner patch. At this junction, two different white vector values WV1 and WV2 may be empirically determined. The first white vector value WV1 is based upon the critical point (shown as point 54 in FIG. 3) at which background noise appears in areas intended to be free of toner. The first white vector value WV1 is set in step 806 at some predetermined safety margin above this point. The second white vector value WV2 is set in step 808 at the value that produces an ideal bloom as discussed above.

Decision step 810 determines whether the second white vector value WV2 is greater than the first white vector value WV1. If it is greater ("Yes" path), the white vector is set at step 812 to the second white vector value WV2. If it is not greater ("No" path), the white vector is set at step 814 to the first white vector value WV1. In essence, these process steps attempt to optimize the white vector operating point at a value that produces an ideal bloom with the constraint that white vector should always be greater than or equal to WV1.

Once the white vector operating point is optimized, the imaging power may be set according to the ideal operating curve 700 shown in FIG. 7. That is, using the optimized white vector, the imaging power is set in step 816 to a corresponding point along the ideal curve 700. Lastly, at step 818, the developer roller 18 bias is adjusted in an effort to maintain an optimal reflectivity value L*, which may be adversely affected during the process of setting a new white vector and setting a new imaging power. This adjustment may be minor and may be a predicted value or may be determined by sensing the reflectivity L* of a second series of solid toner patches. Once the process steps illustrated in FIG. 8 are complete, the routine ends (Step 820) and the image forming device 100 may resume normal operations or enter into other configuration routines.

Figure 9:
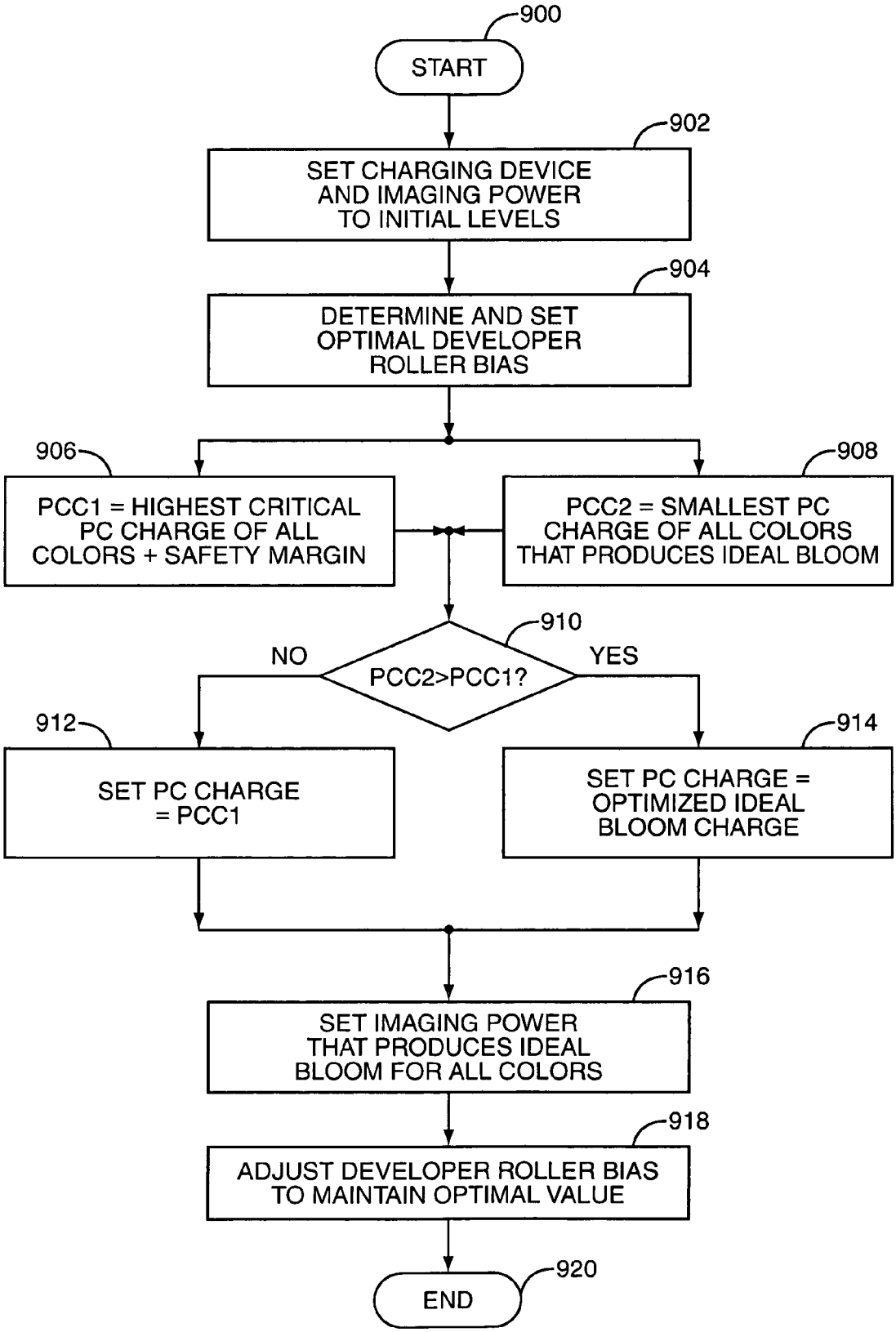
FIG. 9 is a flow diagram of one method of setting operating parameters according to the present invention.

An alternative optimization procedure is shown in FIG. 9. This optimization procedure may be applicable in an image forming device 100 that has independently adjustable imaging powers and developer 18 bias levels, but that uses a common photoconductor 12 charge. Therefore, the white vector may be based on a worst case scenario and may not be optimized for each individual image forming unit 10. This embodiment of an optimization procedure begins as described above. That is, the process starts at step 900 and may be initiated at startup, between print jobs, or in conjunction with other inter-page adjustment procedures. The routine sets initial values for the photoconductive charging device 14 and the imaging power at step 902. As indicated, the photoconductor 12 charge may be set to an initial value that has been shown not to produce background noise in non-printed areas. Similarly, the imaging power may be set to an initial value that is some function of the process speed. Then, in step 904, the controller 40 determines and sets an optimal developer roller 18 bias that produces a target reflectivity L* for a solid toner patch.

At this point, since the photoconductor 12 charge level is the same for each image forming unit 10, the white vector is not independently adjustable. Further, since it is likely that the developer roller 18 bias has been set at different levels at each image forming unit 10, the white vectors (i.e., difference between photoconductor 12 charge and developer roller 18 bias) will be different at each image forming unit 10. Accordingly, the routine attempts to optimize the photoconductor 12 charge to produce an ideal white vector while preventing background noise. Toner patterns are generated over a range of photoconductor 12 charge levels and are analyzed by the patch sensor 126 as shown in FIG. 2. For each image forming unit 10, there will be a critical photoconductor 12 charge level (point 54 in FIG. 3) that generates background noise. A first variable PCC1 is set in step 906 to the highest of these critical values 54 plus some safety margin. Similarly, for each image forming unit 10, there will be a photoconductor 12 charge that produces an ideal bloom, which may be called an ideal bloom charge. Generally, the ideal bloom charge may be different for each image forming unit 10. In step 908, a second variable PCC2 is assigned the lowest of these ideal bloom charges. In decision step 910, PCC2 is compared to PCC1. If PCC2 is not greater than PCC1 ("No" path), the photoconductor 12 charge level is set in step 912 to PCC1. At the very least, this guarantees that there will be no background noise produced by any of the image forming units 10.

If PCC2 is greater than PCC1, then the photoconductor 12 charge level is set in step 914 to some optimized ideal bloom charge. As indicated, there may be a different ideal bloom charge for each color. Thus, the optimized ideal bloom charge may comprise an average, weighted or non-weighted, of the ideal bloom charge determined for some or all image forming units 10. Alternatively, the photoconductor 12 charge level may be set to the ideal bloom charge for a predetermined color, such as black. Alternatively, the photoconductor 12 charge level may be set to the minimum or maximum ideal bloom charge. Since the photoconductor 12 charge level is common among all image forming units 10, some image forming units 10 may have a white vector that is larger or smaller than ideal.

Next, in step 916, imaging power may be varied at each image forming unit 10 to at least partly compensate for possible non-ideal white vectors. At each image forming unit 10, the controller 40 sweeps through a series of imaging powers while printing toner patterns. Then, based on readings from toner patch sensor 126 and bloom calculations, the controller 40 sets the imaging power at a level that produces the most ideal bloom. Lastly, at step 918, the developer roller 18 bias is adjusted in an effort to maintain an optimal reflectivity value L*, which may be adversely affected during the process of setting photoconductor 12 charge level and setting a new imaging power. This adjustment may also be executed following step 912 or 914 depending on the path followed in FIG. 9. This developer bias adjustment may be minor and may be a predicted value or may be determined by sensing the reflectivity L* of a second series of solid toner patches. Once the process steps illustrated in FIG. 9 are complete, the routine ends (Step 920) and the image forming device 100 may resume normal operations or enter into other configuration routines.

Figure 10:
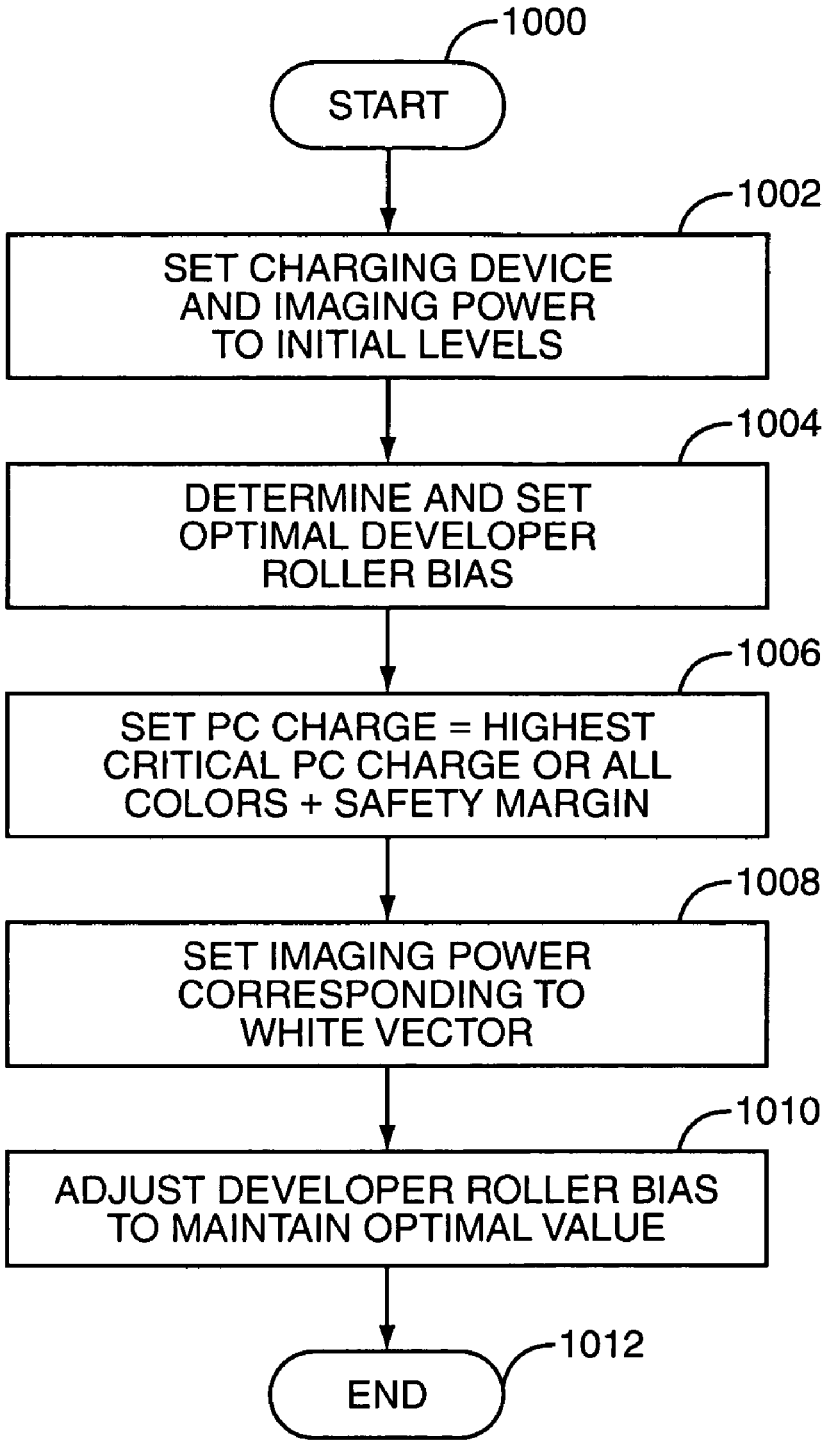
FIG. 10 is a flow diagram of one method of setting operating parameters according to the present invention.

An alternative optimization procedure is shown in FIG. 10. Similar to the procedure shown in FIG. 9, this optimization procedure may be applicable in an image forming device 100 that has independently adjustable imaging powers and developer 18 bias levels, but that uses a common photoconductor 12 charge. This embodiment of an optimization procedure starts at step 1000 and may be initiated at startup, between print jobs, or in conjunction with other inter-page adjustment procedures. The routine sets initial values for the photoconductive charging device 14 and the imaging power at step 1002. As indicated above, the photoconductor 12 charge may be set to an initial value that has been shown not to produce background noise in non-printed areas. Similarly, the imaging power may be set to an initial value that is some function of the process speed. Then, in step 1004, the controller 40 determines and sets an optimal developer roller 18 bias that produces a target reflectivity L* for a solid toner patch.

At this point, since the photoconductor 12 charge level is the same for each image forming unit 10, the white vector is not independently adjustable. In one embodiment, the controller 40 may simply use the initial value for photoconductor 12 charge set in step 1002. Alternatively, the critical points 54 for each image forming unit 10 may be re-verified by generating toner patterns over a range of photoconductor 12 charge levels. These patterns are analyzed by the controller 40 using the patch sensor 126 as shown in FIG. 2 and the highest critical point 54 is identified. Then the common photoconductor 12 charge level is set in step 1006 to the highest of these critical values plus some safety margin. As suggested before, this guarantees that there will be no background noise produced by any of the image forming units 10.

Next, in step 1008, imaging power may be selected using a predictive model such as the ideal operating curve 700 shown in FIG. 7. The imaging power can be set for each image forming unit 10 since white vector may be different for each image forming unit 10. Lastly, at step 1010, the developer roller 18 bias is adjusted in an effort to maintain an optimal reflectivity value L*, which may be adversely affected during the process of setting photoconductor 12 charge level and setting a new imaging power. Once the process steps illustrated in FIG. 10 are complete, the routine ends (Step 1012) and the image forming device 100 may resume normal operations or enter into other configuration routines.

Those skilled in the art should appreciate that the illustrated controller 40 shown in FIG. 2 for implementing the present invention may comprise hardware, software, or any combination thereof. For example, circuitry for setting an optimal operating points may be a separate hardware circuit, or may be included as part of other processing hardware. More advantageously, however, the controller 40 circuitry is at least partially implemented via stored program instructions for execution by one or more microprocessors, Digital Signal Processors (DSPs), ASICs or other digital processing circuits included in the image forming device 10. In other embodiments, some or all of the processing steps executed to establish optimal operating points may be performed in a host computer or other connected computing system.

The present invention may be carried out in other specific ways than those herein set forth without departing from the scope and essential characteristics of the invention. For example, the predictive model for ideal imaging power shown in FIG. 7 is shown relative to a varying white vector. Imaging power may alternatively be based on varying developer bias 18 levels or varying photoconductor 12 charge levels, independent of the other. Furthermore, the exemplary image forming device 100 described herein uses contact-development technology—a scheme that implements physical contact between components to promote the transfer of toner. The white vector optimization may also be incorporated in image forming devices that use jump-gap-development technology—a scheme that implements space between components that are involved in toner development of latent images on the photoconductor. The present embodiments are, therefore, to be considered in all respects as illustrative and not restrictive, and all changes coming within the meaning and equivalency range of the appended claims are intended to be embraced therein.

What is claimed is:

1. An electrophotographic image forming device comprising:

a photoconductive unit;

a charger unit to charge a surface of the photoconductive unit to a first voltage;

an imaging unit forming a latent image on the surface of the photoconductive unit by selectively discharging the surface of the photoconductive unit to second voltage, the imaging unit having an adjustable imaging power;

a developer roller having a surface biased to a third voltage, the developer roller supplying toner to develop the latent image on the surface of the photoconductive unit;

a sensing unit to detect a reflectivity of the toner and a reflectivity of a toner carrying surface on which the toner is deposited;

a controller to selectively adjust the imaging power in response to reflectivity values detected by the sensing unit; and wherein the controller further selectively adjusts the imaging power in response to the difference between the first voltage and the third voltage.

2. The device of claim 1 wherein the controller further manages the formation of a predetermined pattern of toner on the toner carrying surface over a range of imaging power levels and sets the imaging power to the imaging power level that produces a detected reflectivity that matches an expected reflectivity.

3. The device of claim 2 wherein the expected reflectivity is a desired reflectivity at a target halftone percentage.

4. The device of claim 3 wherein the target halftone percentage is between about 5% and about 40%.

5. The device of claim 1 wherein the controller further manages the formation of a plurality of predetermined patterns of toner on the toner carrying surface over a range of imaging power levels, the plurality of predetermined patterns having varying halftone percentages, and sets the imaging power to the imaging power level that produces a detected reflectivity that matches an expected reflectivity.

6. The device of claim 1 wherein the controller further manages the formation of a plurality of predetermined patterns of toner on the toner carrying surface over a range of imaging power levels, the plurality of predetermined patterns having varying halftone percentages, and the controller sets the imaging power to the imaging power level that most nearly produces a linear halftone response.

7. The device of claim 1 wherein the controller further manages the formation of a predetermined pattern of toner on the toner carrying surface over a range of imaging power levels and sets the imaging power to an imaging power level that produces a desired bloom.

8. In an electrophotographic imaging device, a method of setting an imaging power that is applied to expose a photoconductive surface to create a latent image, the method comprising:

creating a plurality of predetermined latent images on said photoconductive surface by selectively exposing portions of said photoconductive surface, each of the predetermined latent images having a target halftone percentage, and each of the predetermined latent images being generated with a different imaging power;

developing the predetermined latent images on the photoconductive surface by supplying toner to the photoconductive surface;

measuring a reflectivity of the developed images; and setting said imaging power to produce a target reflectivity at the target halftone percentage.

9. The method of claim 8 wherein the target halftone percentage is between about 5% and about 40%.

10. The method of claim 8 further comprising measuring a first reflectivity of a solid toner patch, measuring a second reflectivity of a toner carrying surface on which the developed images are disposed, generating an ideal halftone response curve between the first reflectivity and the second reflectivity, and wherein the target reflectivity is a point along the ideal halftone response curve corresponding to the target halftone percentage.

11. The method of claim 8 further comprising setting said imaging power to produce a target reflectivity at the target halftone percentage after optimizing a white vector value to produce an ideal bloom.

12. The method of claim 8 wherein the reflectivity of the developed images is measured as a luminance value.

13. The method of claim 8 wherein target reflectivity at the target halftone percentage represents a target bloom.

14. In an electrophotographic imaging device, a method of setting an imaging power that is applied to expose a charged photoconductive surface to generate a latent image on said photoconductive surface, the method comprising:

creating plurality of sets of predetermined latent images on said charged photoconductive surface, each of the plurality of sets of predetermined latent images having a target halftone percentage, each of the predetermined latent images in a set being generated with a different imaging power, and each set of the plurality of sets of predetermined latent images being generated with a different difference in electrical potential between a developer member and the charged photoconductive surface;

developing the predetermined latent images on the photoconductive surface by supplying toner from the developer member to the photoconductive surface;

measuring a reflectivity of the developed images; and generating a predictive model for setting the imaging power based at least partly on ascertained imaging powers that produce a target reflectivity for each set of the plurality of sets of predetermined latent images, wherein generating the predictive model comprises storing a table of values correlating the imaging powers that produce the target reflectivity for each set of the plurality of sets of predetermined latent images.

15. The method of claim 14, further comprising setting an imaging power for a given difference in electrical potential between the developer member and the charged photoconductive surface using the predictive model.

16. The method of claim 14 wherein generating a predictive model comprises fitting an operating curve between the imaging powers that produce a target reflectivity for each set of the plurality of sets of predetermined latent images.

17. The method of claim 16, further comprising setting an imaging power for a given difference in electrical potential between the developer member and the charged photoconductive surface by selecting an operating point along the operating curve.

18. The method of claim 14, further comprising setting an imaging power for a given difference in electrical potential between the developer member and the photoconductive surface by reading an operating point from the table of values.

19. The method of claim 14 wherein the target halftone percentage is between about 5% and about 40%.

20. In an electrophotographic imaging device, a method of setting operating points for a photoconductive surface potential, for an imaging power that is applied to expose the photoconductive surface to generate a latent image on the photoconductive surface, and for a developer member bias of a developer member that supplies toner to develop the latent image, the method comprising:

setting initial values for a photoconductive surface potential and the imaging power;

setting the developer member bias to produces a target reflectivity for a solid toner patch;

setting the photoconductive surface potential to a predetermined amount above a critical point for a first color at which toner is transferred to areas of the photoconductive surface that are intended to be free from toner; and setting the imaging power that produces a toner pattern having a target reflectivity.

21. The method of claim 20 wherein setting the imaging power that produces a toner pattern having a target reflectivity comprises determining an imaging power that produces a reflectivity that is near ideal at a target halftone percentage.

22. The method of claim 20 wherein selling the imaging power that produces a toner pattern having a target reflectivity comprises determining an imaging power that produces an ideal bloom.

23. The method of claim 20 wherein the critical point for a first color is estimated from a predetermined critical point of a second color.

* * * * *